US009022627B2

(12) United States Patent
Lessard et al.

(10) Patent No.: US 9,022,627 B2
(45) Date of Patent: May 5, 2015

(54) LENS AND RETAINER COMBINATION

(71) Applicants: Jason Lessard, Bow, NH (US); Aaron Plaza, Canterbury, NH (US); Mark Seymour, Hillsboro, NH (US)

(72) Inventors: Jason Lessard, Bow, NH (US); Aaron Plaza, Canterbury, NH (US); Mark Seymour, Hillsboro, NH (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 14/011,194

(22) Filed: Aug. 27, 2013

(65) Prior Publication Data

US 2015/0062952 A1 Mar. 5, 2015

(51) Int. Cl.

| | |
|---|---|
| ***F21V 7/04*** | (2006.01) |
| ***F21S 8/10*** | (2006.01) |
| ***F21V 5/04*** | (2006.01) |
| ***F21V 17/06*** | (2006.01) |
| ***F21V 17/16*** | (2006.01) |
| *F21Y 101/02* | (2006.01) |

(52) U.S. Cl.

CPC ..... *F21S 48/1208* (2013.01); *F21V 5/04* (2013.01); *F21V 17/06* (2013.01); *F21V 17/164* (2013.01); *F21Y 2101/02* (2013.01)

(58) Field of Classification Search

CPC .... B31K 26/00; F21S 48/155; F21S 48/2206; F21S 48/255; F21V 17/00

USPC ..... 362/549, 362, 376

See application file for complete search history.

(56) References Cited

U.S. PATENT DOCUMENTS

| | | | | |
|---|---|---|---|---|
| 1,913,819 | A * | 6/1933 | Rileigh | 362/516 |
| 2,122,342 | A * | 6/1938 | Foley et al. | 362/374 |
| 3,793,517 | A * | 2/1974 | Carlini | 362/106 |
| 5,208,731 | A | 5/1993 | Blomquist | |
| 5,241,453 | A | 8/1993 | Bright et al. | |
| 5,299,632 | A | 4/1994 | Lee | |
| 5,343,362 | A | 8/1994 | Solberg | |
| 5,421,402 | A | 6/1995 | Lin | |
| 5,495,392 | A | 2/1996 | Shen | |
| 5,696,424 | A | 12/1997 | Coushaine | |
| 5,855,430 | A | 1/1999 | Coushaine et al. | |
| 5,917,701 | A | 6/1999 | Solberg | |
| 6,022,241 | A * | 2/2000 | Lin | 439/419 |
| 6,254,252 | B1 | 7/2001 | Coushaine et al. | |
| 6,308,772 | B1 | 10/2001 | Obara et al. | |
| 6,381,813 | B1 | 5/2002 | Lai | |
| 6,787,999 | B2 | 9/2004 | Stimac et al. | |
| 6,863,418 | B2 * | 3/2005 | Masuoka et al. | 362/264 |
| 7,230,831 | B2 | 6/2007 | Luckner et al. | |
| 8,018,136 | B2 | 9/2011 | Gingrich, III et al. | |
| 8,482,923 | B2 | 7/2013 | Tan et al. | |

(Continued)

*Primary Examiner* — Sean Gramling

*Assistant Examiner* — Omar Rojas Cadima

(74) *Attorney, Agent, or Firm* — Edward S. Podszus

(57) ABSTRACT

A retainer (23) includes two retainer portions (20, 21) surrounding lens (2). Lens (2) has a bearing surface (14) and an abutment surface (12), preferably two of each. In an intermediate stage of assembly, retainer portions when placed in confronting relation to each other around the lens are undersized in a lateral direction relative a principal dimension of lens (2). A projection (22) from a retainer portion (20, 21) bears against lens bearing surface (14), and an abutment-receiving structure (24), such as an aperture, bears against lens abutment (12). When the retainer portions (20, 21) are squeezed together and permanently connected, such as by weldment (40), projection (22) is urged more firmly against lens bearing surface (14) and lens abutment surface (12) is urged against lens aperture (24). Retainer portions (20, 21) are symmetric, and formed of sheet steel.

9 Claims, 7 Drawing Sheets

(56) References Cited

U.S. PATENT DOCUMENTS

2001/0006454 A1 7/2001 Huang et al.
2009/0034283 A1 2/2009 Albright et al.
2010/0213814 A1 8/2010 Seymour et al.
2010/0213815 A1 8/2010 Aghamehdi et al.

* cited by examiner

LENS AND RETAINER COMBINATION

CROSS REFERENCE TO RELATED APPLICATIONS

N/A

TECHNICAL FIELD

The present disclosure relates generally to a retainer for a lens, and, more particularly, to a tight-fitting combination of a lens and retainer suitable to withstand vehicle vibration.

BACKGROUND

It is known to connect a metal holding cup to a press seal region of a lamp capsule, and to weld the cup to a sheet metal retaining bracket attached to the base of an automobile lamp. See generally US published applications US 2010/0213814 (Seymour et al.); US2010/0213815 (Aghamehdi et al.); and U.S. Pat. No. 5,855,430 (Coushaine et al.).

Vehicle headlamps are subject to road vibration which may loosen them and lessen their alignment. The present inventors determined it is desirable to retain a lens securely without clamping retainer to an optical surface of the lens.

BRIEF DESCRIPTION OF THE DRAWINGS

Reference should be made to the following detailed description which should be read in conjunction with the following figures, wherein like numerals represent like parts.

Figure 1:
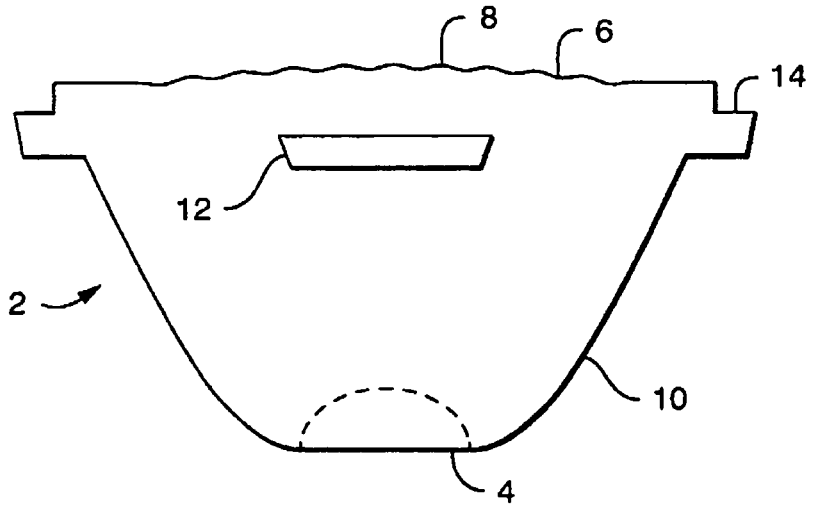
FIG. 1 illustrates a longitudinal side view of a lens.

For a thorough understanding of the present disclosure, reference should be made to the following detailed description, including the appended claims, in connection with the above-described drawings. Although the present disclosure is described in connection with exemplary embodiments, the disclosure is not intended to be limited to the specific forms set forth herein. It is understood that various omissions and substitutions of equivalents are contemplated as circumstances may suggest or render expedient. Also, it should be understood that the phraseology and terminology used herein is for the purpose of description and should not be regarded as limiting.

DETAILED DESCRIPTION INCLUDING BEST MODE OF A PREFERRED EMBODIMENT

In general, the present disclosure is directed to a lens and retainer combination. A retainer 23 includes two retainer portions 20, 21 surrounding lens 2. Lens 2 has a bearing surface 14 and an abutment surface 12, preferably two of each. In an intermediate stage of assembly, retainer portions when placed in confronting relation to each other around the lens are undersized in a lateral direction relative a principal dimension of lens 2, such as the lens width W. A projection 22 from a retainer portion 20, 21 bears against lens bearing surface 14, and an abutment-receiving structure 24, such as an aperture, bears against lens abutment 12. When the retainer portions 20, 21 are squeezed together and permanently connected, such as by weldment 40, projection 22 is urged more firmly against lens bearing surface 14 and lens abutment surface 12 is urged against lens aperture 24. Retainer portions 20, 21 are symmetric, and formed of sheet steel. Preferably lens 2 has the bearing surface 14 and the abutment surface 12 formed on different principal faces. More preferably, lens 2 has two bearing surfaces 14, one at each opposite lateral face, and two abutment surfaces 12, one on each opposite longitudinal face.

A lens and retainer combination consistent with the present disclosure provides a means of securing holding the lens to be free of subsequent loosening due to vehicle vibration. Once the lens is secured within the retainer, the lens focus is aligned relative to a light source, such as an LED, formed on a printed circuit board (PCB). A bracket 42 is coupled to the PCB. The retainer is welded, such as by spot welding, to the bracket 42.

Figure 2:
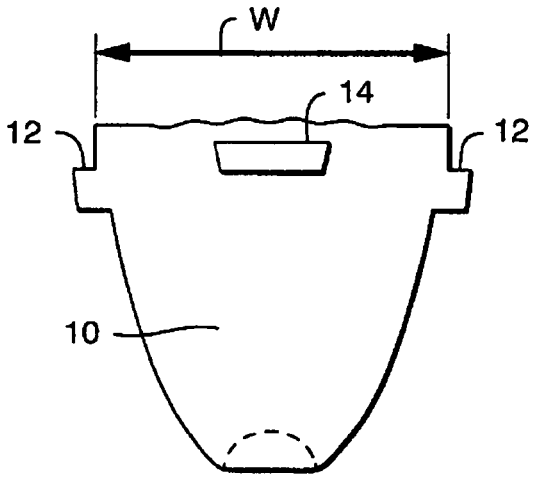
FIG. 2 illustrates a lateral side view of the lens.

Turning now to the drawings, FIG. 1 and FIG. 2 illustrate a longitudinal side view and a lateral side view, respectively, of a lens 2. Lens 2 has a light entrance surface 4, preferably to receive light from an LED light source 52 (see FIG. 10). Lens 2 has a light exit surface 6 which contains beam shaping optics 8 such as pillow lens to spread light. Lens 2 has lateral optical surfaces 10 to internally direct received light, such as by internal reflection, from entrance surface 4 towards exit surface 6. Lens 2 has at least one abutment surface 12, which is formed on a longitudinal face, and at least one bearing surface 14 formed on a lateral face. Preferably lens 2 has one abutment surface 12 formed on each of the longitudinal faces, and one bearing surface 14 formed on each of the lateral faces. In a preferred embodiment, the abutment surface 12 and the bearing surface 14 both stand proud of the body of lens 2, and have sufficient width away from the lens body to receive, respectively, the thickness of aperture 24 and the foot-shaped region of projection 22, as depicted for example in FIG. 6 below. As seen in lateral view in FIG. 2, lens 2 has a width dimension W between opposed longitudinal faces. Lens 2 can have a typical width W of approximately 45 mm in a region when retainer portions 20, 21 are attached. A typical overall length along a top surface at the light exit surface 6 is about 90 mm. Lens 2 is preferably monolithic. Lens 2 can be cast of optical glass or of optical grade plastic, such as PMMA (polymethyl methacrylate). When made of plastic in a size suitable for an automobile exterior lamp, e.g. fog lamp, as given above for width W of 45 mm and length 90 mm, lens 2 is relatively heavy with a mass of about 120 grams (about 4 ounces).

Figure 3:
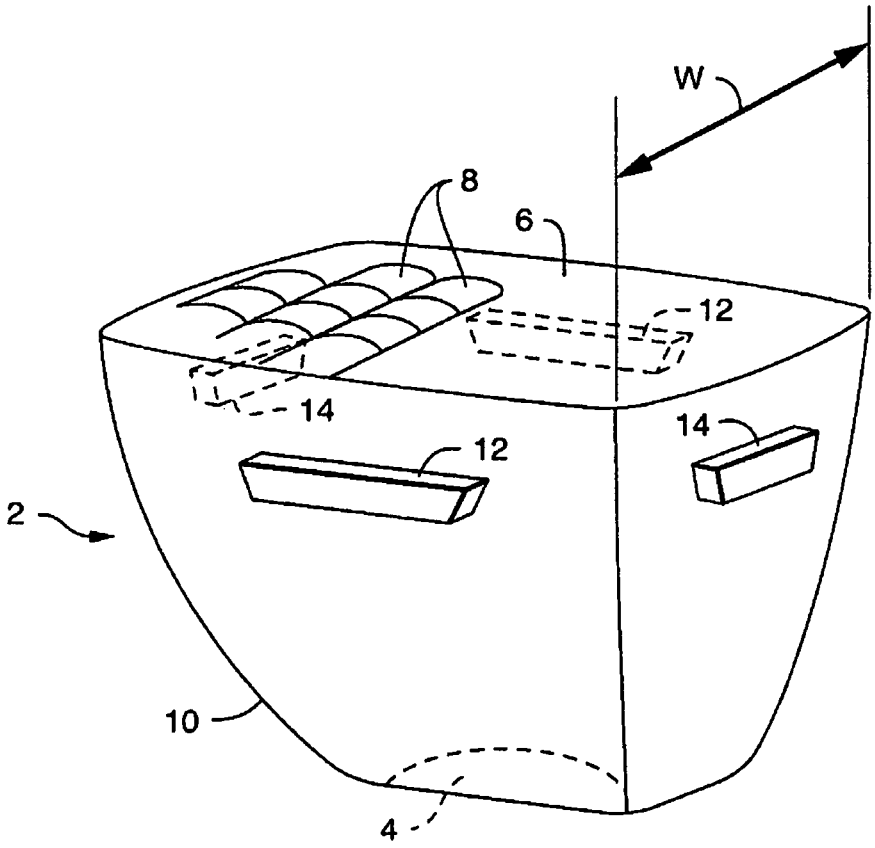
FIG. 3 illustrates a perspective view of the lens.

FIG. 3 illustrates lens 2 in perspective view, showing bearing surface 14 and abutment surface 12 on the hidden faces in phantom line.

Figure 4:
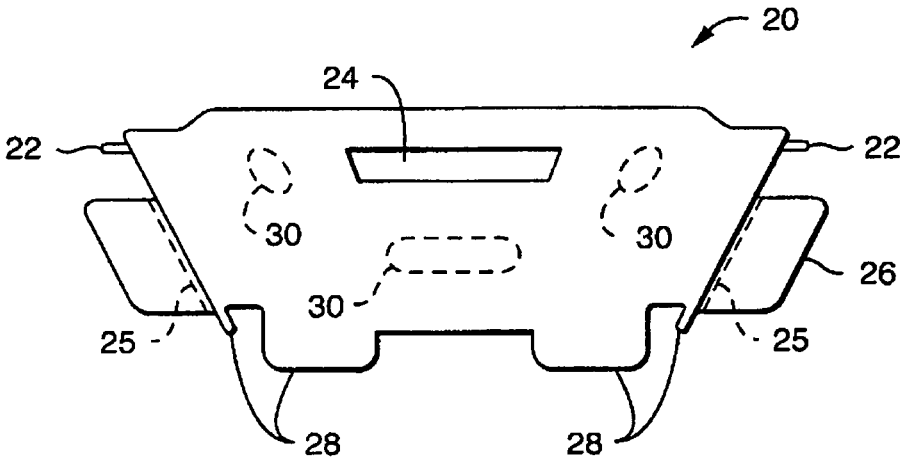
FIG. 4 illustrates a longitudinal side view of the retainer portion.
Figure 5:
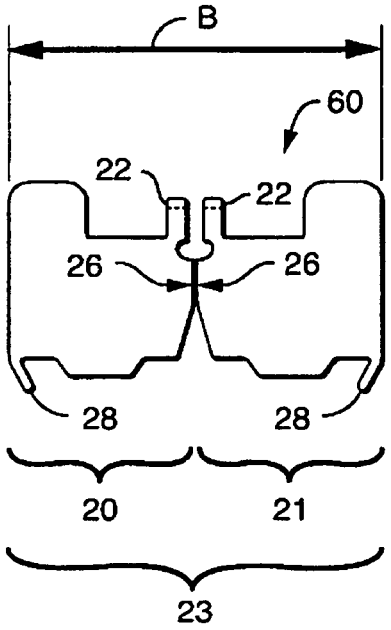
FIG. 5 illustrates a side view of two confronting retainer portions.

FIG. 4 and FIG. 5 illustrate a longitudinal side view and a lateral side view, respectively, of a retainer portion 20. The retainer is made of two symmetric first and second retainer portions 20, 21. For simplicity, reference can be made to a first retainer portion 20 for a discussion of features. Retainer portion 20 is conveniently formed of a sheet metal material about 1 mm thick, and is slightly flexible. First retainer portion 20 has an upwardly directed and outwardly bent projection 22 at each end. Projection 22 is formed as a bent finger that is approximately L-shaped. Adjacent each projection 22 is a connection tab 26, which form regions for spot-weldment 40 in a subsequent assembled condition upon fixation. Retainer portion 20 also has an aperture 24 which is stamped into the sheet material; aperture 24 defines an abutment-receiving region that in an assembled condition bears against abutment 12 of lens 2. Retainer portion 20 includes stiffening ribs or beads 30 that serve to stiffen the longitudinal side of retainer portion 20. The projection 22 and connection tab 26 are formed on a side face that is bent along bend 25 inward from the face on which aperture 24 is cut out. Retainer portion 20 also includes alignment securement tabs 28, preferably four. As formed in a preferred embodiment in a size to approximately surround lens 2 as hereindescribed, retainer portion 20 has a mass of about 20 gram.

As shown in FIG. 5, retainer 23 results from the aggregation of first retainer portion 20 and second retainer portion 21. When first and second retainer portions 20, 21 are loosely held together in confronting, mating relation, in the absence of lens 2, and with their respective connection tabs 26 touching, an internal cavity that forms a lens-receiving region 60 having a width B is defined that is slightly less than a corresponding width dimension W of lens 2. Thus, the loosely assembled (but not permanently connected or welded) first and second retainer portions 20, 21 define a retainer 23 that is slightly undersized relative to a principal dimension (W) of lens 2.

Figure 6:
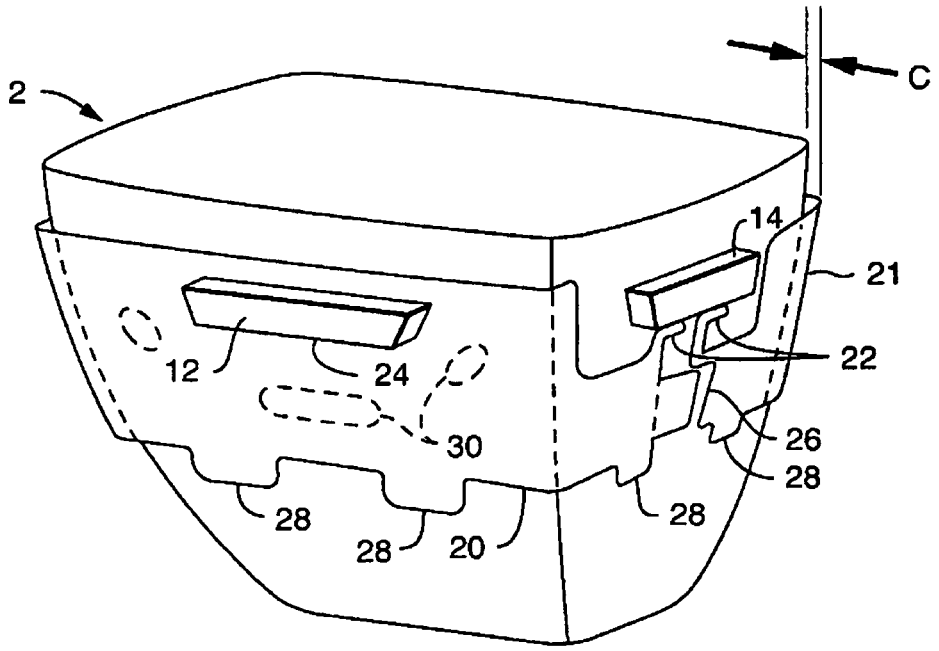
FIG. 6 illustrates a perspective view of the lens and two confronting retainer portions during assembly.
Figure 7:
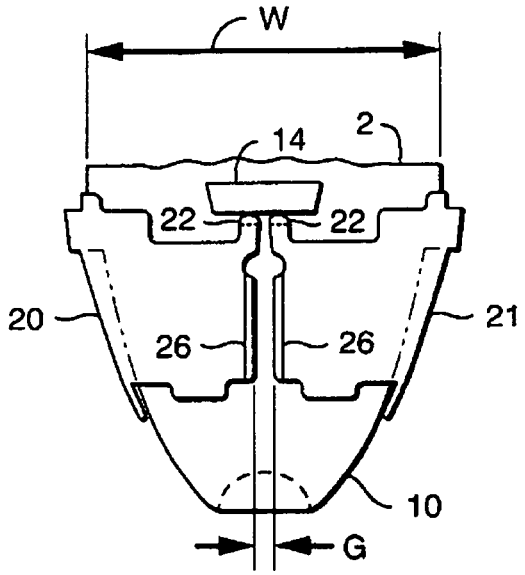
FIG. 7 illustrates a side view of the lens and two confronting retainer portions during assembly prior to fixedly joining the retainer portions.

FIG. 6 illustrates in perspective view the first and second retainer portions 20, 21 positioned in an unassembled (in the sense of not yet being permanently connected or welded) mating, confronting relation with the lens 2 disposed between the first and second retainers 20, 21, there is a space between adjacent connection tabs 26 of respective retainer portions 20, 21, as conveniently seen in FIG. 7. This gap G is approximately 1.5 mm for the size lens 2 and retainer portions 20, 21 described above, but one of skill in the art understands this gap will be chosen based on such factors as stiffness of the retainer portions and desired overall retention force to be exerted on lens 2. Projections 22, preferably at their foot-like distal regions, bear against bearing surfaces 14. Aperture 24 receives lens abutment surface 12 and surrounds the abutment surface 12. A length of retainer portions 20, 21 is chosen relative to a longitudinal extent of lens 2 so that a clearance C facilitates that the retainer portion narrow faces, upon which connection tabs 26 are upturned during sheet-metal forming, flex or pivot about longitudinal sides of lens 2 during permanent fixation, as described further hereinbelow.

Figure 8:
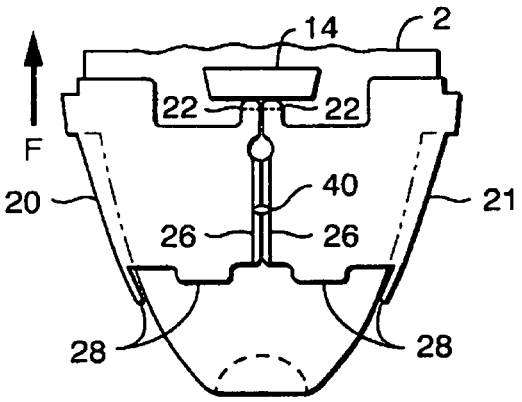
FIG. 8 illustrates a side view of the lens and two confronting retainer portions after assembly after fixedly joining the retainer portions to each other to capture the lens.

During permanent fixation, as depicted in FIG. 8, the confronting connection tabs 26 are squeezed into contact (see FIG. 8) and the projections 22 urge upward against an underside of lens bearing surface 14 (see arrow F in FIG. 8), whereby the lens' abutment surface 12 is urged against the aperture 24, thus promoting firm connection between lens 2 and retainer 23. Weldment 40, such as a spot weld, retains this position fixedly joined. Alternative joints could be formed such as laser welding, crimping, or use of mechanical fasteners (e.g. rivets, bolts) that may or may not require presence of connection tabs 26.

FIG. 6 illustrates an advantage of the present embodiment that with first and second retainer portions 20, 21 assembled to lens 2, the first and second retainer portions 20, 21 avoid impinging on optical surfaces of lens 2, that is the surfaces that guide and shape light in lens 2.

Figure 9:
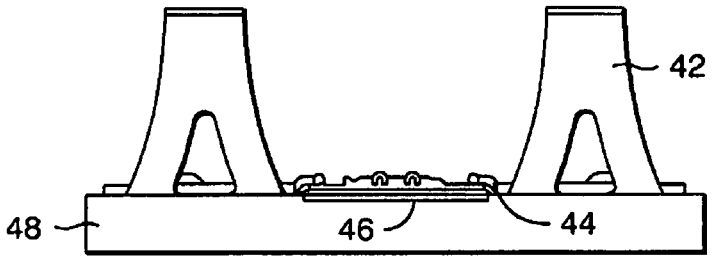
FIG. 9 illustrates a side view of a bracket and heat sink.
Figure 10:
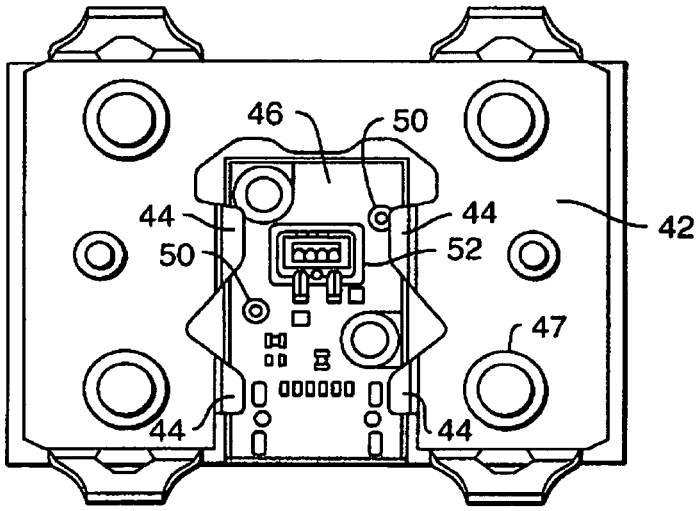
FIG. 10 illustrates a top view of a bracket connected to a heat sink and holding the PCB with light source to the heat sink.
Figure 11:
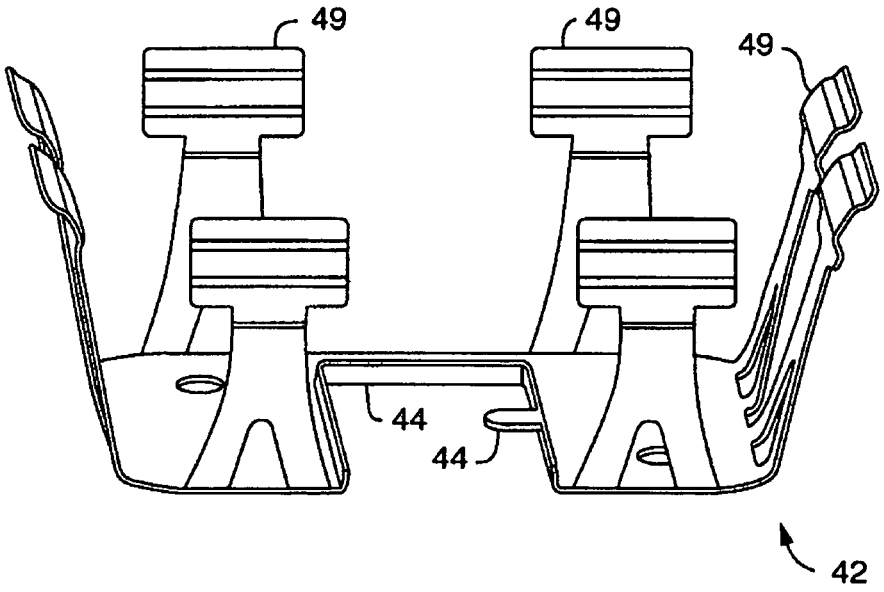
FIG. 11 illustrates a perspective view of the bracket.

FIG. 9, FIG. 10 and FIG. 11 depict a bracket that is advantageously used with the combination lens 2 and retainer 23. Bracket 42 has eight abutments 49 formed on eight arms that receive the eight alignment securement tabs 28 of retainer 23, at which locations, after the lens and retainer combination has been aligned relative to light source 52 (e.g., LED or LEDs), the retainer 23 can be welded. Bracket 42 is preferably made of sheet material such as sheet metal. Bracket 42 is secured to heat sink 48 by four screws 47. Heat sink 48 is made of a thermally conductive material, such as an aluminum or copper alloy. Heat sink 48 advantageously conducts heat away from light source 52, which is mounted on PCB 46 which is aligned by alignment pins 50. Bracket 42 also defines two hold-down tabs 44 (see FIG. 11) or four such hold-down tabs 44 (see FIG. 10) by which PC board 46 and light source 52 are urged into thermal contact with heat sink 48. Previously, it was common in the art to attach a printed circuit board bearing LED light source to a heat sink with thermal tape or adhesive or by screws, which may be considered a more secure thermal connection than tape or adhesive. However, screws had the disadvantage of having screw heads that protrude above the upper surface of the PC board, a disadvantage which could not be fully removed by partially grinding down the screw heads since a stump of the heads would remain. The screw heads had the disadvantage that they could interfere with the placement or alignment of the light entrance surface of a lens, such as lens 2, in close proximity to a light source 52. To avoid the need for screws to retain the PCboard/light source, bracket 42 is formed with inwardly facing hold-down tabs 44. Since hold-down tabs 44 are formed of the sheet material, they are made thin, and can be positioned in regions around the periphery of PC board 46 where a light entrance surface 4 of lens 2 is not present. This facilitates more freedom of displacement of the lens 2 and retainer 23 combination through (i.e., "above and below") the focal point relative to light source 52 to better align the optics prior to welding retainer 23 to bracket 42 to form the finished automotive lamp.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

The following is a non-limiting list of reference numerals used in the specification:

2 lens
4 light entrance surface
6 light exit surface
8 shaping optics
10 optical surface
12 abutment surface of lens
14 bearing surface of lens
20 first retainer portion
21 second retainer portion
22 projection
23 retainer
24 aperture (abutment-receiving structure)
25 bend
26 connection tab
28 alignment securement tabs
30 beads (strengthening ribs)
40 weldment
42 bracket
44 hold-down tab
46 printed circuit board (PCB)
47 screw(s)
48 heat-sink
49 abutment on bracket
50 alignment pins
52 light source
60 lens-receiving region
B width of lens-receiving region in retainer
C clearance
F force arrow
G gap (between connection tabs)
W width of lens

What is claimed is:

1. A lens (2) and retainer (23) combination, comprising:

a lens (2) having a light entrance surface (4), a light exit surface (6);

a first retainer portion (20) and a second retainer portion (21);

said lens (2) comprising at least one lens bearing surface (14) and at least one lens abutment surface (12) and having a lens width dimension (W), said bearing surface disposed along said width dimension;

at least one of said first and second retainer portions (20, 21) being formed of resilient sheet material and comprising at least one projection (22) adapted to bear against said lens bearing surface (14) and an abutment-receiving structure (24) adapted to bear against said lens abutment surface (12);

wherein said first and second retainer portions (20, 21), when placed in unassembled mating, confronting relation to each other, together define a retainer (23) having a lens-receiving region (60) having an internal width (B) slightly less than said lens width dimension (W);

wherein when said first and second retainer portions (20, 21) are in confronting relation with said lens (2) disposed therebetween, said at least one retainer projection (22) abuts against said lens bearing surface (14) and said abutment-receiving structure (24) bears against said lens abutment surface (12); and wherein when said first and second retainer portions (20, 21) are fixedly joined to one another, said at least one projection (22) is urged against said lens bearing surface (14), whereby said lens abutment surface (12) is urged against said lens abutment-receiving surface (24).

2. The combination of claim 1, wherein each said first and second retainer portions (20, 21) comprise a respective said at least one projection (22) and a respective said abutment-receiving surface (24).

3. The combination of claim 1, wherein said lens (2) has a pair of bearing surfaces (14, 14) opposed to each other and a pair of abutment surfaces (12, 12).

4. The combination of claim 1, wherein said first and second retainer portions (20, 21) are fixedly joined to one another by a weldment (40).

5. The combination of claim 1, wherein said lens (2) is monolithic.

6. The combination of claim 1, wherein said lens (2) is formed of a plastics material.

7. The combination of claim 1, wherein said first and second retainer portions (20, 21) further comprise connection tabs (26) adapted to fixedly join said retainer portions.

8. The combination of claim 1, wherein said abutment-receiving structure (24) is formed as an aperture defined in said at least one retainer portion (20, 21).

9. The combination of claim 1, wherein said first and second retainer portions (20, 21) further comprise alignment securement tabs (28) defining datum surfaces for alignment relative to a bracket (42) and whereby said retainer (23) is securable thereto.

* * * * *